US010814157B1

(12) United States Patent
Ransom

(10) Patent No.: US 10,814,157 B1
(45) Date of Patent: Oct. 27, 2020

(54) WEARABLE WEIGHTED EXERCISE SYSTEM AND METHOD OF USE

(71) Applicant: Francois Ransom, Dallas, TX (US)

(72) Inventor: Francois Ransom, Dallas, TX (US)

( * ) Notice: Subject to any disclaimer, the term of this patent is extended or adjusted under 35 U.S.C. 154(b) by 0 days.

(21) Appl. No.: 16/375,137

(22) Filed: Apr. 4, 2019

(51) Int. Cl.
*A63B 21/065* (2006.01)

(52) U.S. Cl.
CPC ..... *A63B 21/065* (2013.01); *A63B 2225/68* (2013.01)

(58) Field of Classification Search
CPC ..... A63B 21/0004; A63B 21/0601; A63B 21/0603; A63B 21/065; A63B 21/068; A63B 21/4007; A63B 21/4009; A63B 21/4011; A63B 21/4023; A63B 21/4025; A63B 21/4027; A63B 21/4039; A63B 21/4041; A63B 21/4043; A63B 24/0062; A63B 2024/0065; A63B 2220/10; A63B 2220/13; A63B 2220/17; A63B 2220/30; A63B 2220/31; A63B 2220/36; A63B 2220/40; A63B 2220/50; A63B 2220/51; A63B 2220/54; A63B 2220/56; A63B 2220/58; A63B 2220/80; A63B 2220/83; A63B 2220/833; A63B 2220/836; A63B 2225/50; A63B 2225/52; A63B 2225/54; A63B 2225/68; A63B 2225/685; A63B 2230/00; A63B 2230/04; A63B 2230/045; A63B 2230/06; A63B 2230/062; A63B 2230/065; A63B 2230/067; A63B 2230/08; A63B 2230/085; A63B 2230/205; A63B 2230/206; A63B 2230/207; A63B 2230/208; A63B 2230/30; A63B 2230/305; A63B 2230/50; A63B 2230/505; A63B 2230/65; A63B 2230/655
See application file for complete search history.

(56) References Cited

U.S. PATENT DOCUMENTS 4,303,239 A * 12/1981 Walsh, Jr. ..... A63B 21/0603 482/105
5,144,694 A * 9/1992 Conrad Da oud ... A63B 21/065 2/102
5,553,322 A * 9/1996 Cebo-Johnson ..... A63B 21/065 2/69
5,937,441 A * 8/1999 Raines ..... A63B 21/065 2/227
RE46,069 E * 7/2016 Gibson-Horn ..... A63B 26/003
9,968,141 B2 * 5/2018 Ward ..... G01N 1/2273
10,576,324 B2 * 3/2020 Dolcetti ..... A63B 21/00061
(Continued)

*Primary Examiner* — Gary D Urbiel Goldner

(57) ABSTRACT

A weighted suit, includes a sleeveless suit to fit around a torso area of a user and having a zipper to secure the sleeveless suit in place on the torso; a first pair of weights integrated into a chest portion of the sleeveless suit; a second pair of weights integrated into an upper back portion of the sleeveless suit; a third pair of weights integrated into thigh regions; and a control system sewn into the sleeveless suit and having a power source; a wireless chip; and one or more sensors incorporated into the control system and to receive and determine data associated with a workout; each weight of the first, second, and third pair of weights is permanently sewn into the sleeveless suit to be completely enclosed by a material that the sleeveless suit is composed of, thereby being permanently incorporated into the sleeveless suit.

6 Claims, 6 Drawing Sheets

(56) References Cited

U.S. PATENT DOCUMENTS

| | | | | |
|---|---|---|---|---|
| 2009/0042702 | A1* | 2/2009 | Toronto | A63B 21/0552 482/124 |
| 2011/0043755 | A1* | 2/2011 | Gibson-Horn | A61F 5/026 351/203 |
| 2017/0252601 | A1* | 9/2017 | McKenzie | A41D 13/0015 |
| 2017/0304670 | A1* | 10/2017 | Herron | A61B 5/6804 |
| 2018/0056104 | A1* | 3/2018 | Cromie | A63B 21/4007 |
| 2019/0001181 | A1* | 1/2019 | Veasley | A63B 21/0442 |
| 2019/0059461 | A1* | 2/2019 | Walker | A41B 1/08 |
| 2019/0111307 | A1* | 4/2019 | White | D04B 1/18 |
| 2019/0133215 | A1* | 5/2019 | Whalen | A61B 5/6804 |
| 2019/0134454 | A1* | 5/2019 | Mahoney | A63B 21/065 |
| 2019/0160652 | A1* | 5/2019 | Mahoney | B25J 9/0006 |
| 2019/0283237 | A1* | 9/2019 | Witherspoon | A61H 3/00 |
| 2019/0283247 | A1* | 9/2019 | Chang | A61H 1/0244 |

* cited by examiner

WEARABLE WEIGHTED EXERCISE SYSTEM AND METHOD OF USE

BACKGROUND

1. Field of the Invention

The present invention relates generally to exercise systems, and more specifically, to a wearable weighted exercise system that includes a one-piece suit having weights sewn into the suit and further having one or more wearable sensors built into the suit for providing the wearer with workout feedback.

2. Description of Related Art

Wearable exercise systems are well known in the art and are effective means to increase the intensity of exercise. For example, FIG. 1 depicts a conventional wearable exercise system 10 having a weighted vest 12 with a front portion 14 and one or more straps 16 configured to secure the vest to the wearer. During use, the vest 12 is worn to increase the intensity of the workout.

One of the problems commonly associated with system 10 is its limited use. For example, the suit is generally inflexible and does not include any wearable technology to provide the user with feedback pertaining to their workout.

Accordingly, although great strides have been made in the area of wearable weighted exercise systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
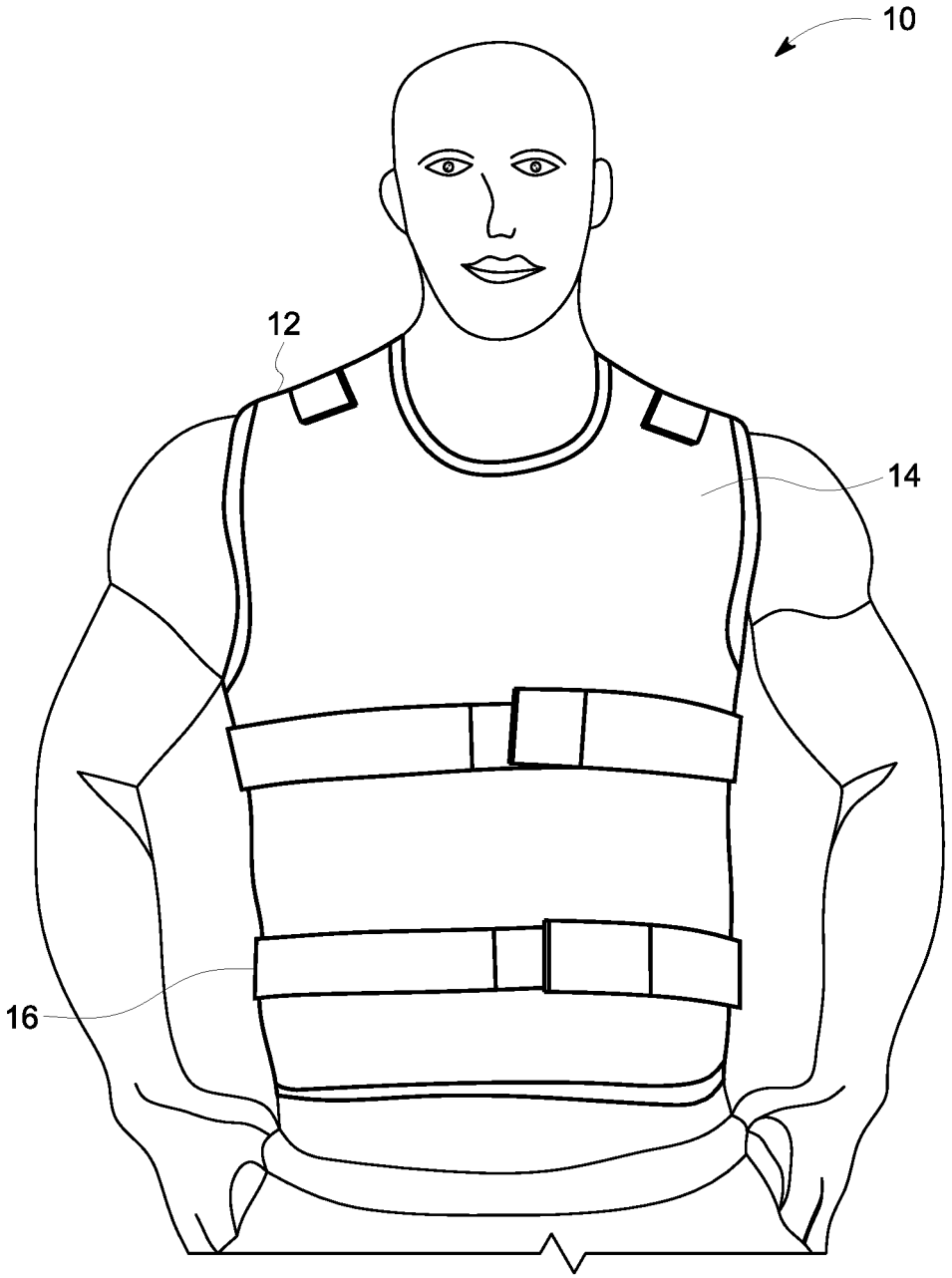
FIG. 1 (PRIOR ART)
FIG. 1 is a front view of a common wearable exercise system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional wearable exercise systems. Specifically, the present invention provides for a suit that is comfortable, weighted, and includes wearable technology to provide feedback to the user. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
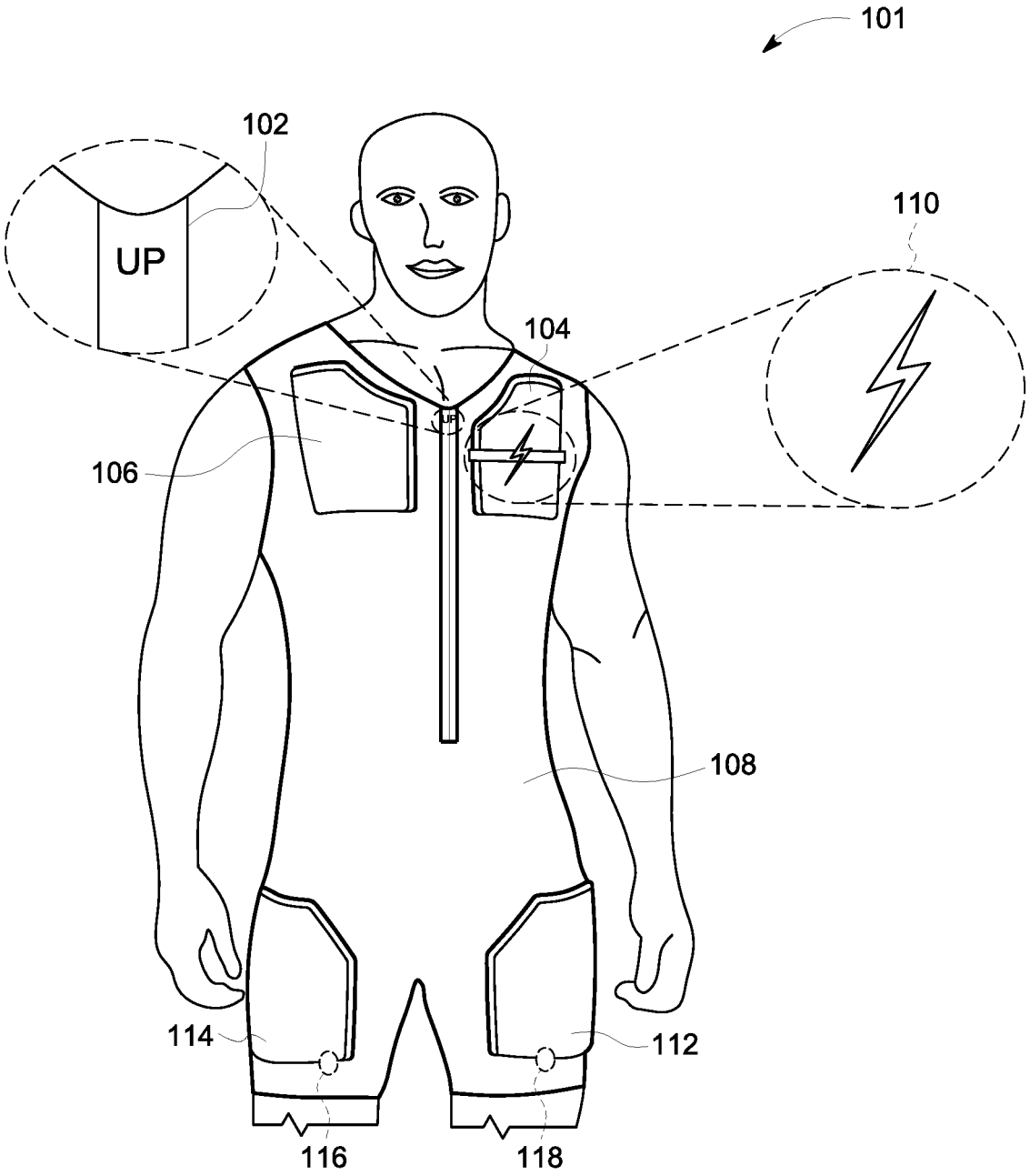
FIG. 2 is a front view of a wearable weighted exercise system in accordance with a preferred embodiment of the present application.

Referring now to the drawings wherein like reference characters identify corresponding or similar elements throughout the several views, FIG. 2 depicts a front view of a wearable weighted exercise system in accordance with a preferred embodiment of the present application. It will be appreciated that system 101 overcomes one or more of the above-listed problems commonly associated with conventional wearable weighted exercise systems.

Figure 3:
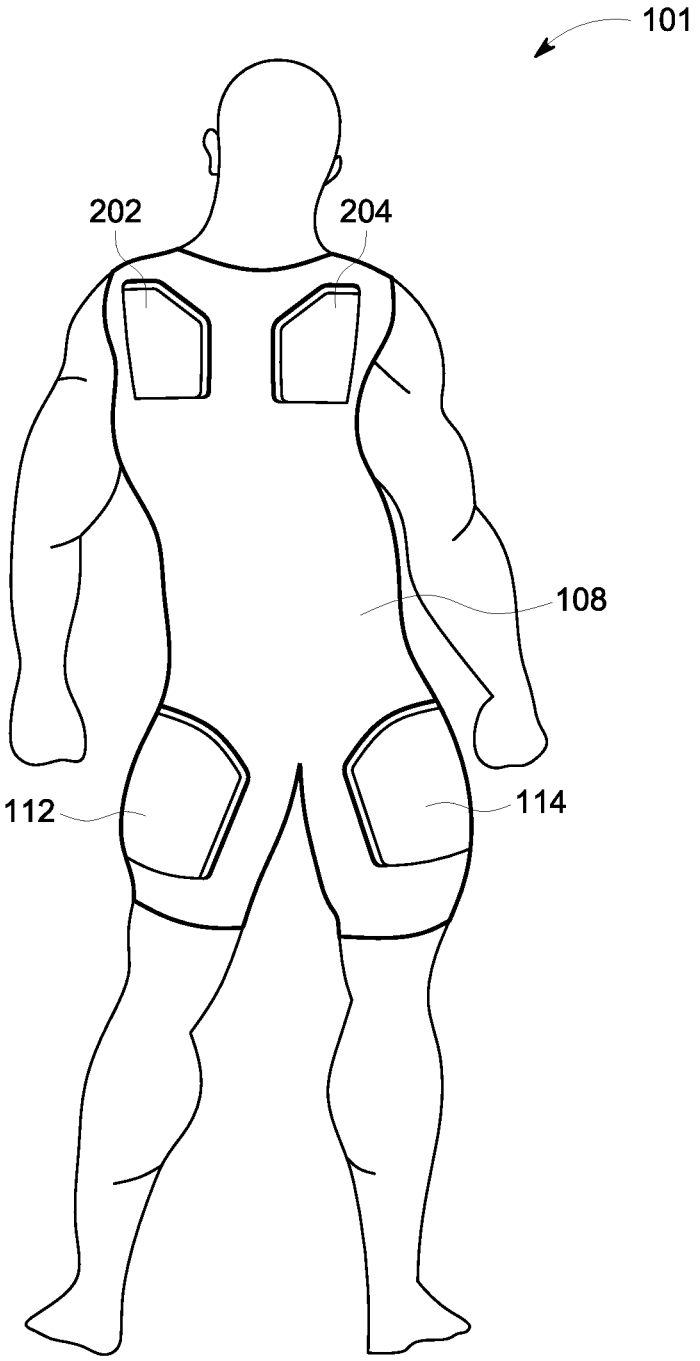
FIG. 3 is a back view of the system of FIG. 2.
Figure 4:
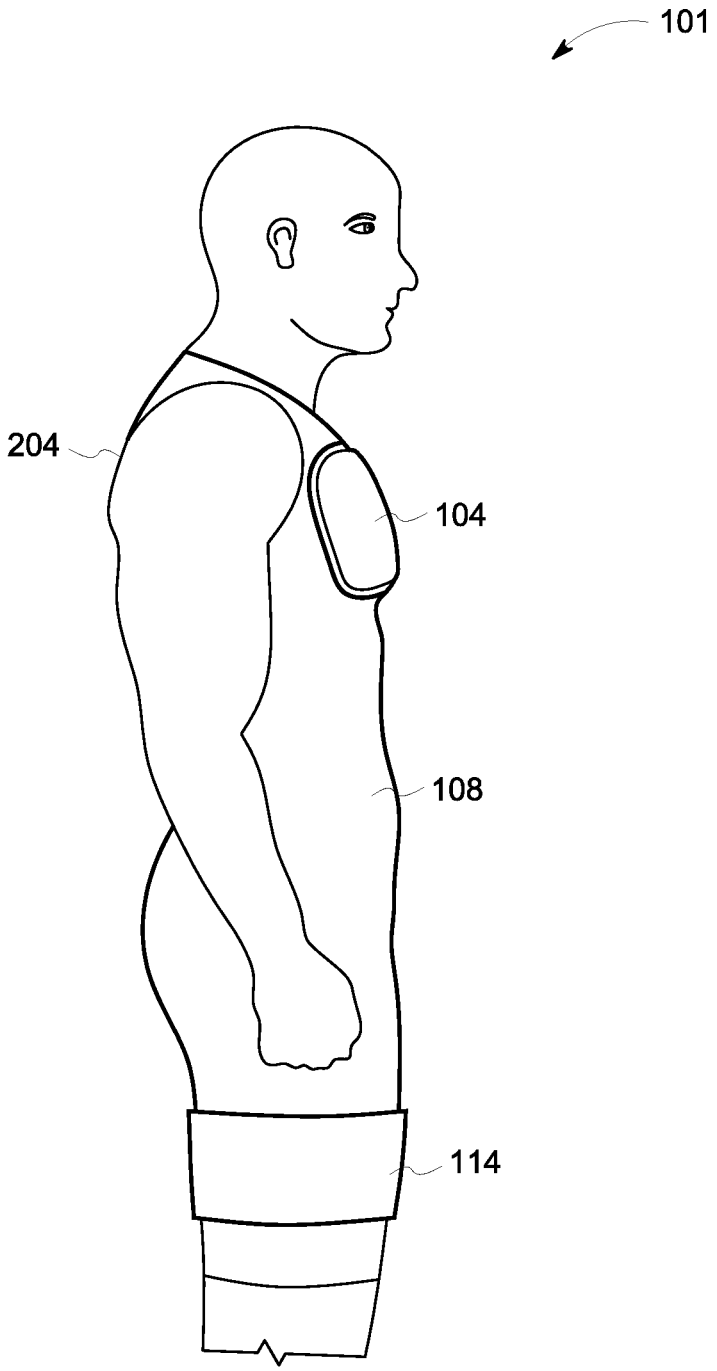
FIG. 4 is a side view of the system of FIG. 2.

In the contemplated embodiment, system 101 includes a suit 108 with two front upper body weights 104, 106 and two lower body weights 112, 114. The front upper body weights are positioned on the user's chest, which keeps the weights at a location that does not hinder the user's workout. Further, the lower body weights 114, 112 are positioned to wrap around the user's thighs, as shown in FIG. 4, thereby again ensuring that the user retains flexibility and comfort during use. As shown in FIG. 3, the back view further shows two upper body back weights 202, 204 positioned at the top of suit 108. It must be understood that there are no weights on the arms of the user, which provides for full movement and flexibility of the user's arms.

Suit 108 is a single, sleeveless garment configured to secure around the user's torso and having two leg compartments to extend to above the user's knees. Suit 108 includes a single zipper 102 configured to zip up the suit once in place on the user. Suit 108 having no removable components or the like and is composed of a neoprene material. It should be appreciated that the neoprene allows for moisture wicking and also provides a protective barrier for the user's skin. It should be appreciated that 101 lack of removable components, and the one-piece feature of the suit makes system 201 novel as it is easy to manufacture, take care of, and transport. In the preferred embodiment, suit 108 is further sleeveless, thereby allowing for full maneuverability of the user's arms.

Lastly, in reference to suit 108, it should be understood that neoprene is known for immense physical toughness, thereby providing the user with improved cushioning and protection for fragile areas of the body. In addition, it must be appreciated that suit 108 is completely latex free, thereby being suitable for persons with common allergies.

It should be appreciated that the weights of the present invention can vary in size and weight, wherein the total weight can range from 10 pounds to 75 pounds. This allows for the user to select a weight that is best suitable for their needs.

In the preferred embodiment, the top front and back weights are each an approximate size of 21×10 centimeters. Likewise, in the preferred embodiment, the lower weights are approximately 21×28 centimeters.

Figure 5:
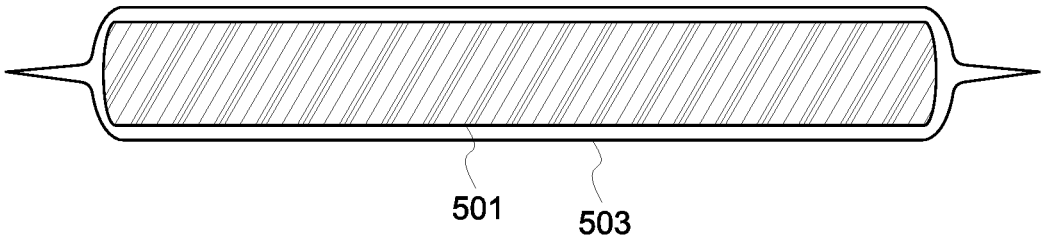
FIG. 5 is a cross sectional view of one of the weights of FIG. 2.

The weights of system 101 are specifically woven/sewn into the material that composes the suit, preferably with a polyester thread. One specifically contemplated thread is a heavy-duty polyester thread, such as Kevlar® thread, known to be strong, durable, and heat resistant. In addition, it is contemplated that the thread should be of a weight approximately 30 LBS. It should further be appreciated that this thread can be used in all aspects of system 201 not just for use in stitching the weights into the suit. In FIG. 5, a cross sectional view shows a weight 501 (which should be understood to be any of the weights discussed above) sewn into material 503 which makes up the suit. It should be understood that weight 501 is completely encompassed within the material, thereby not being in a position to come in contact with the user's skin. The neoprene material is stitched around the entire weight, thereby enclosing the weight.

Figure 6:
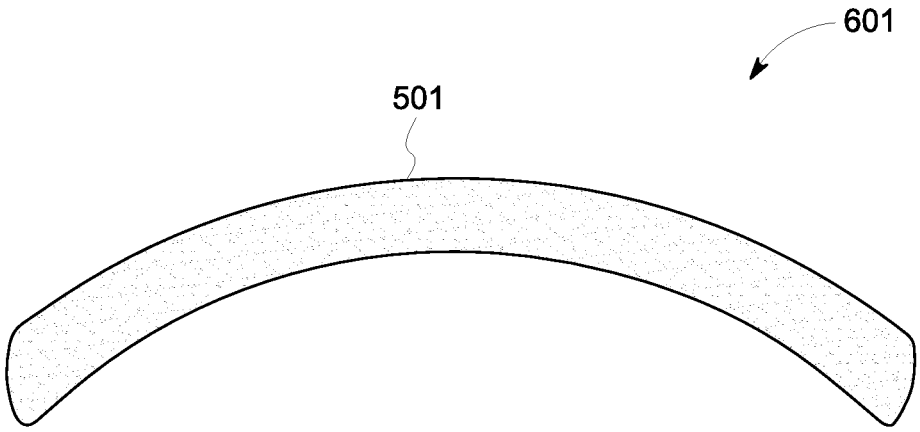
FIG. 6 is a side view of one of the weights of FIG. 2.

In FIG. 6, weight 501 is shown, wherein weight 501 is filled in an internal cavity with an iron sand 601 to reach the desired weight. In the preferred embodiment, the body of weight 501 is composed of a soft, impenetrable rubber pouch, thereby preventing leaking of the sand. In addition, the rubber pouch is flexible, thereby allowing for the weight to move with the user's body, as shown in FIG. 6.

It should be appreciated that one of the unique features believed characteristic of the present application is that upper and lower body weighted components are integrated into the suit 108 without need for use of pockets, compartments, or any other open chamber, thereby preventing the weights from becoming disoriented or dislodge from the particular placement of the weights during use. It is contemplated that weighted components can be integrated into the suit 108 by stitching, weaving, fusing, or by any other means and completely disposed within the thickness of the suit.

It is also contemplated and will be appreciated that so long as weighted components are not located at the user's center of mass, such as the hips or waist, that system 101 will additionally engage the user's core musculature (not shown) for stability during exercise.

Another unique feature believed characteristic of the present application is that system 101 can be easily adopted by a user for personal training or coaching. For example, because the weighted components are fully integrated into suit 108 the system 101 can be treated as a single unit to eliminate the need to track, maintain, or store individual system components.

Some of the unique feature of the suit include that there are not separate components, e.g., a shirt and shorts, and that the suit is a single piece of garment. In addition, there are no pocket and no need to take weighted material in and out of a pocket. The material is woven into the soft, stretchable rubber suit material and there is no need to clean the weights. The suit material is also washable, which in turn greatly increases the desired use as conventional suits become scented with sweat after a single use. In one contemplated embodiment, the weighted material is composed of an elastic material, which in turn allows for expanding and contracting as the user exercises.

It should be appreciated that one of the benefits and unique features of the present system is the ability of the system to be washed in its entirety, without removing the weights and without any special equipment.

In some embodiments, system 101 incorporates wearable technology that is configured to provide feedback to the user. As shown in FIG. 2, system 101 can include a control system 110 embedded and/or sewn in the suit and located near the user's chest/heart, the control system 110 having a plurality of components configured to collect data from one or more sensor and transfer the data to a device, such as a phone, tablet, or computer. Further, as shown in FIG. 2, system 101 can include one or more pressure sensors 116, 118, that include wireless technology that allow for transmission of pressure data to a wireless device. The pressure sensors 116, 118 are sewn or embedded into the suit 108 and positioned on the user's thighs to collect data.

Figure 7:
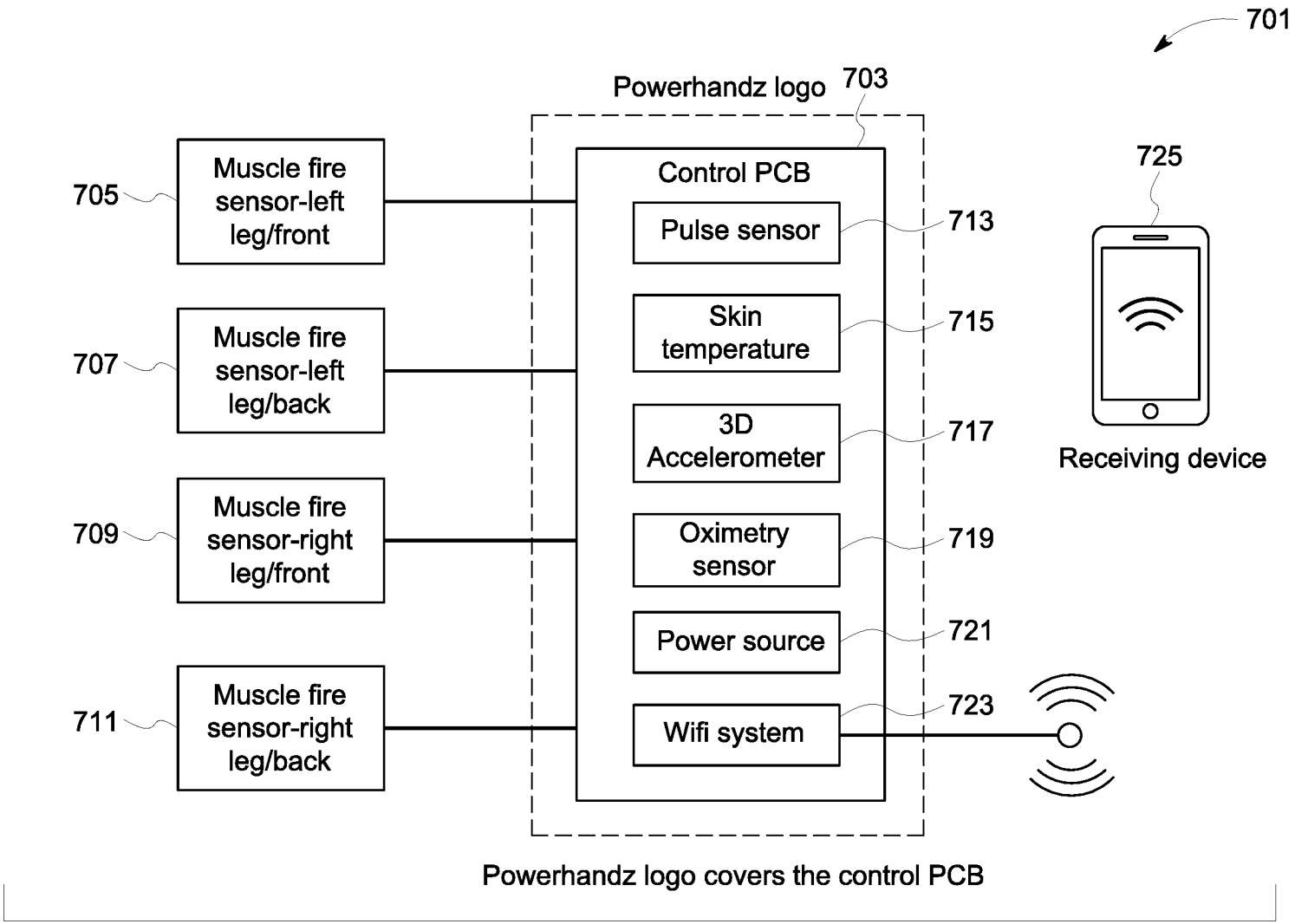
FIG. 7 is a schematic of the control system of FIG. 2.

In FIG. 7, a simplified schematic 701 further depicts features contemplated to incorporate into the control system 703. The control system 703 can be configured to facilitate communication with a plurality of pressure sensors 705, 707, 709, 711, wherein these sensors are configured to collect and determine data such as average firing rate, minimum firing rate, and maximum firing rate, and the time duration associated with the minimum and maximum.

The control system 703 can further include a pulse sensor 705, which is configured to determine data such as an average pulse, a minimum pulse, and a maximum pulse, as well as a time duration associated with the minimum and maximum. In some embodiments, the pulse sensor 705 is incorporated directly into the control system.

The control system 703 can further include a skin temperature sensor 715 configured to determine data such as an average skin temperature, a minimum skin temperature, and a maximum skin temperature, as well as a time duration associated with the minimum and maximum. In some embodiments, the skin temperature sensor 715 is incorporated directly into the control system.

The control system 703 can further include an accelerometer 717 configured to determine data such as an average speed, a minimum speed, and a maximum speed, as well as a time duration associated with the minimum and maximum. In some embodiments, the accelerometer 717 is incorporated directly into the control system.

The control system 703 can further include an oximetry sensor 719 configured to determine data such as an average oximetry, a minimum oximetry, and a maximum oximetry, as well as a time duration associated with the minimum and maximum. In some embodiments, the oximetry sensor 719 is incorporated directly into the control system.

It should be appreciated that the control system 703 includes a power source 721, such as a removable battery, a rechargeable battery, or any other power source, and further includes a wireless chip 723 configured to allow the control system 703 to transmit the data to a receiving device 725, such as a mobile phone, tablet, or other computing device. It should be appreciated and understood that the data can be presented to the user in any variety of forms, including charts, graphs, notifications, or any other means.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A weighted suit, comprising:

a sleeveless suit composed of a neoprene material and configured to fit around a torso area of a user and having a zipper to secure the sleeveless suit in place on the torso area, the sleeveless suit having:

two leg compartments configured to extend to above a knee of the user;

a first pair of weights integrated into a chest portion of the sleeveless suit;

a second pair of weights integrated into an upper back portion of the sleeveless suit;

a third pair of weights integrated into thigh regions of the two leg compartments; and a control system sewn into the sleeveless suit, the control system having:

a power source;

a wireless chip configured to allow the control system to communicate with a receiving device; and one or more sensors incorporated into the control system and configured to receive and determine data associated with a workout;

wherein each weight of the first, second, and third pairs of weights is permanently sewn into the sleeveless suit to be completely enclosed by a material that the sleeveless suit is composed of, thereby being permanently incorporated into the sleeveless suit.

2. The weighted suit of claim 1, wherein the one or more sensors comprises:

a pulse sensor;

a skin temperature sensor;

an accelerometer; and an oximetry sensor.

3. The weighted suit of claim 1, wherein the one or more sensors are incorporated directly into the control system.

4. The weighted suit of claim 1, further comprising:

one or more pressure sensors embedded into the sleeveless suit and configured to be located at a thigh position of the user;

wherein the one or more pressure sensors are configured to communicate data to the control system.

5. The weighted suit of claim 1, wherein each weight of the first, second, and third pairs of weights comprises:

a rubber pouch forming an interior cavity; and a pre-determined amount of iron sand permanently secured within the interior cavity of the rubber pouch;

wherein the rubber pouch is configured to flex with movement of the user.

6. The weighted suit of claim 1 wherein the neoprene material is 100% latex free.

* * * * *